US009574838B2

(12) United States Patent
Giannini et al.

(10) Patent No.: US 9,574,838 B2
(45) Date of Patent: Feb. 21, 2017

(54) LIVE-ROUND PREVENTION WITH BUILT-IN BLANK FIRING ADAPTER

(71) Applicant: DefendSafe, LLC, Oceanside, CA (US)

(72) Inventors: Carol Giannini, Oceanside, CA (US); David Tarzi, Oceanside, CA (US); Michael Cheramie, Oceanside, CA (US); Erik Kalnicki, Jacksonville, NC (US)

(73) Assignee: DefendSafe, LLC, Oceanside, CA (US)

( * ) Notice: Subject to any disclaimer, the term of this patent is extended or adjusted under 35 U.S.C. 154(b) by 0 days.

(21) Appl. No.: 14/942,090

(22) Filed: Nov. 16, 2015

(65) Prior Publication Data

US 2016/0069631 A1 Mar. 10, 2016

Related U.S. Application Data

(63) Continuation of application No. 14/493,973, filed on Sep. 23, 2014, now Pat. No. 9,188,402.

(60) Provisional application No. 61/890,540, filed on Oct. 14, 2013, provisional application No. 61/890,538, filed on Oct. 14, 2013.

(51) Int. Cl.

| | |
|---|---|
| ***F41A 21/26*** | (2006.01) |
| ***F41A 21/16*** | (2006.01) |
| ***F41A 9/64*** | (2006.01) |
| ***F41A 17/00*** | (2006.01) |
| ***F41A 21/00*** | (2006.01) |
| ***F41A 17/44*** | (2006.01) |
| ***F41A 21/12*** | (2006.01) |

(52) U.S. Cl.

CPC ..... *F41A 21/16* (2013.01); *F41A 9/64* (2013.01); *F41A 17/00* (2013.01); *F41A 17/44* (2013.01); *F41A 21/00* (2013.01); *F41A 21/12* (2013.01)

(58) Field of Classification Search

CPC ..... F41A 17/44; F41A 21/26; F41A 21/325
USPC ..... 42/49.02, 70.01, 70.11, 76.01; 89/14.05, 89/29

See application file for complete search history.

(56) References Cited

U.S. PATENT DOCUMENTS

| | | | | | |
|---|---|---|---|---|---|
| 1,005,115 | A | * | 10/1911 | Hatlanek | F41A 21/28 122/DIG. 13 |
| 1,331,018 | A | * | 2/1920 | Luthy | H01M 2/18 429/143 |
| 1,407,633 | A | * | 2/1922 | Burton | F41A 9/71 42/49.02 |
| 2,003,290 | A | * | 6/1935 | Gurney | F41C 27/06 124/58 |
| 2,840,944 | A | * | 7/1958 | Thompson | F41A 9/71 102/448 |
| 4,128,040 | A | * | 12/1978 | Schuetz | F41A 33/00 89/14.5 |
| 4,266,356 | A | * | 5/1981 | Jarvinen | F41A 17/44 42/70.11 |

(Continued)

*Primary Examiner* — Michael David
(74) *Attorney, Agent, or Firm* — Brown Rudnick LLP; Mark S. Leonardo

(57) ABSTRACT

The invention relates to safety components/modifications for a firearm barrel for preventing discharge of live ammunition from the firearm. The invention includes one embodiment of a modified barrel including a rod member transversely positioned within a portion of the bore of the barrel adjacent to the chamber to prevent chambering or loading of a live round. The modified barrel further includes a standard blank-firing adapter (BFA) fixedly coupled to the distal or muzzle end of the barrel.

9 Claims, 8 Drawing Sheets

(56) References Cited

U.S. PATENT DOCUMENTS 4,969,283 A * 11/1990 Baehr ..... F41A 33/00 42/70.01
5,140,893 A * 8/1992 Leiter ..... F41A 21/26 89/14.5
5,740,626 A * 4/1998 Schuetz ..... F41A 21/28 42/106
6,470,615 B1 * 10/2002 Peterken ..... F41A 17/44 42/70.01
6,526,684 B1 * 3/2003 Hickerson ..... F41A 17/44 42/70.01
6,871,438 B2 * 3/2005 Lawless ..... F41A 33/00 42/70.01
7,380,363 B1 * 6/2008 Kirschner ..... F41A 17/44 42/76.01
7,658,138 B2 * 2/2010 Wossner ..... F41A 17/44 42/76.01
7,954,269 B2 * 6/2011 Laney ..... F41C 9/08 42/51
8,028,455 B1 * 10/2011 Battaglia ..... F41A 9/71 42/49.02
8,499,676 B1 * 8/2013 Moore ..... F41A 21/325 42/90
2004/0154208 A1 * 8/2004 Walker ..... F41C 27/00 42/79
2004/0154209 A1 * 8/2004 Walker ..... F41C 27/00 42/79
2007/0079540 A1 * 4/2007 Giebel ..... F41A 17/063 42/70.11
2007/0095198 A1 * 5/2007 Dater ..... F41A 21/325 89/14.2
2008/0156183 A1 * 7/2008 Brittingham ..... F41A 21/325 89/14.4
2010/0050493 A1 * 3/2010 Joseph ..... F41A 21/40 42/79
2010/0275491 A1 * 11/2010 Leiter ..... F41A 33/02 42/76.01
2010/0313457 A1 * 12/2010 Dueck ..... F41A 21/26 42/1.01
2010/0313743 A1 * 12/2010 Dueck ..... F41A 21/325 89/14.05
2011/0154711 A1 * 6/2011 Dickerson ..... F41A 21/325 42/107
2013/0000170 A1 * 1/2013 Dueck ..... F41A 21/26 42/1.01
2013/0180150 A1 * 7/2013 Dueck ..... F41A 21/325 42/90
2014/0173963 A1 * 6/2014 Kent ..... F41A 21/26 42/90
2015/0101231 A1 * 4/2015 Giannini ..... F41A 21/00 42/76.01

* cited by examiner

LIVE-ROUND PREVENTION WITH BUILT-IN BLANK FIRING ADAPTER

CROSS-REFERENCE TO RELATED APPLICATIONS

The present application is a continuation of U.S. patent application Ser. No. 14/493,973, filed Sep. 23, 2014, which claims the benefit of, and priority to, U.S. Provisional Application Ser. No. 61/890,538, filed Oct. 14, 2013 and U.S. Provisional Application Ser. No. 61/890,540, filed Oct. 14, 2013, the contents of each of which are incorporated by reference herein in their entirety.

FIELD OF THE INVENTION

The present disclosure relates generally to firearm safety, and, more particularly, to safety components for and/or modifications to a barrel of a firearm for live-round prevention in the firearm.

BACKGROUND

Firearm safety is an increasingly important issue. Generally, the overall purpose of firearm safety is to eliminate or minimize the risks of unintentional death, injury, or damage caused by improper possession, storage, or handling of firearms. One major area of concern is the prevention of inadvertent discharge of a firearm loaded with real, or live, ammunition, particularly in instances in which the firearm was thought to be either unloaded or loaded with blank ammunition. This is an ongoing concern in fields in which the handling and use of firearms is routine, such as the military and law enforcement.

Military forces, for example, conduct drills, simulated combat, and training exercises using live-fire firearms loaded with blank ammunition in place of live ammunition, so as to provide a realistic element to the situation. The term "live-fire" as used herein refers to the ability of the firearm to discharge live ammunition. The military is aware that extra precaution is required so as to ensure that the firearm is loaded only with blank rounds (e.g., cartridges, shells, etc.) during these exercises. However, blank-fire operations are inherently dangerous because a live cartridge, or round, may be inserted, either mistakenly or intentionally, into a firearm, creating the possibility that a user will discharge the live round, which may injure or kill another participant.

For example, in order to simulate combat against an enemy, blank-fire training often calls for a participant to "fire" a blank-loaded weapon at other participants in the training exercise who are acting as opposing forces. When a live round is introduced into the weapon and fired at a participant, serious injury and death may result.

In some training exercises, the military utilizes civilian personnel and equips them with weapons that are live-fire capable, but loaded with blank ammunition. The inclusion of civilians in training exercises has proven to be very useful, as civilians provide the necessary diversity, friction and realism required. However, even with screening and background checks, the issue remains that one or more of the civilians may be a rogue individual trying to bring harm to the personnel being trained and may thus intentionally load a weapon with live ammunition so as to cause harm to other participants. Furthermore, an improperly trained civilian may inadvertently load a weapon with live ammunition, thus presenting a situation in which the discharge of a live round may result, which may injure or kill another participant.

There are currently a variety of different safety systems that are directed to reducing the risk of unwanted discharge of live ammunition, particularly in training situations. For example, some firearms are manufactured solely for the purpose of firing non-standard blank cartridges, such that they are not live-fire capable. However, such "training-only" firearms take away from realistic training, are limited in their use (e.g., not live-fire capable), and may be costly. Some systems include blank-firing adapters (BFA) positioned at the end of a barrel of a firearm. The BFA generally allows blank cartridges to cycle with most automatic firearms. The BFA is designed such that if a live round is mistakenly fired, most of the energy is spent colliding with and smashing through the BFA, reducing both the range and damage inflicted by the live round. However, trainees may forget to check whether the weapon has been loaded with live ammunition. If the weapon is loaded with a live round and fired, artillery from the magazine will strike the BFA, causing the gun to explode in the hands of the operator.

SUMMARY

The present disclosure is generally directed to safety components for and modifications to a barrel of a firearm for preventing discharge of live ammunition from the firearm. The safety components and modifications are adapted to prevent live ammunition from ever being loaded into the chamber of a firearm, thereby rendering the firearm completely safe for use in training scenarios, while maintaining maximum realism.

In certain aspects, the invention includes a modified barrel for use with a firearm. The modified barrel includes a safety modification, including a rod member positioned within a portion of the bore of the barrel adjacent to the chamber to prevent insertion or loading of a live round. In particular, the rod member includes a first end, a second end, and a central portion defined there between. The first end of the rod member is received through a first aperture defined on a proximal portion of the barrel (adjacent the chamber portion) and passes transversely through the barrel relative to the length of the barrel and is further received through a second aperture opposing the first aperture. When in place, the central portion of the rod member is substantially orthogonal or perpendicular to a longitudinal axis formed along the length of the barrel. The rod member is securely fixed within the barrel by way of welds to the first and second ends at the first and second apertures, thereby making the safety modification permanent.

The modified barrel furthers include a standard blank-firing adapter (BFA) fixedly coupled to the distal or muzzle end of the barrel. The distal end of the barrel is modified to include threading within the bore operable to receive a corresponding threaded connector member of a BFA. Upon coupling of the BFA to the distal end of the barrel, the BFA is securely fixed to the distal end of the barrel by way of welding to prevent removal, thereby providing a permanently coupled BFA.

In another aspect, the invention includes an alternative embodiment of a modified barrel having a modified bore for live-round prevention. The modified bore is shaped and/or sized to prevent chambering and further discharge of a live round. In particular, the dimensions of the chamber portion at the proximal end of the modified barrel are insufficient (i.e. too small) to receive a standard live round for a particular firearm, thereby preventing chambering and discharge of a live round. Rather, the chamber portion is shaped and/or sized to receive only blank rounds for use with the particular firearm. Further, the bore of the distal end or muzzle of the barrel is shaped and/or sized to mimic the dimensions of a BFA bore, thereby providing a built-in BFA modification for the barrel.

Each of the embodiments described herein may further include visual indications (e.g. markings) for providing indication that the firearm is a blank-only weapon. In particular, components including the safety modifications described herein, such as the permanently attached BFA and the modified barrel, may include visual markings indicating the blank-firing operability.

The safety components and/or barrel modifications of the present disclosure reduce accidental or deliberate firing of live ammunition, particularly during non-live fire training. The safety components/modifications are adaptable to most weapon systems, and are especially suitable for automatic weapons, including assault rifles. The embodiments of the invention described herein provide relatively simple and effective modifications to previously live-fire capable weapons, thereby providing realistic Opposing Forces or Opposition Force (OPFOR) weapons that produce an effective sound signature. The embodiments described herein increase safety, require less inspections and supervisory personnel, and provide realistic training.

BRIEF DESCRIPTION OF THE DRAWINGS

Features and advantages of the claimed subject matter will be apparent from the following detailed description of embodiments consistent therewith, which description should be considered with reference to the accompanying drawings.

DETAILED DESCRIPTION

Figure 1:
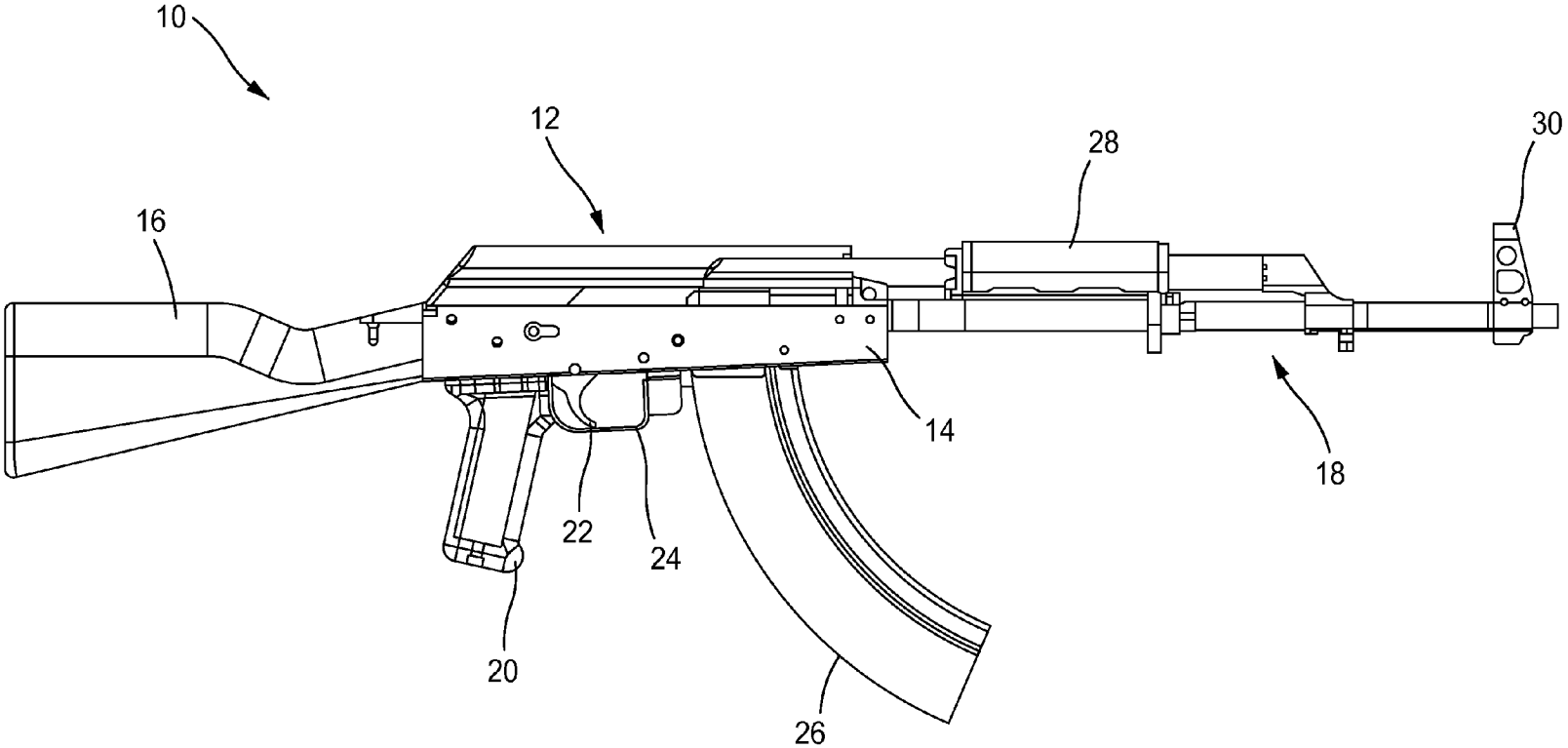
FIG. 1 is a side view of a firearm having a conventional configuration.

By way of overview, the present disclosure is generally directed to one or more safety components for and/or modifications to a firearm barrel adapted to reduce accidental or deliberate firing of live ammunition, particularly during non-live fire training.

In one aspect, the invention includes a modified barrel for use with a firearm. The modified barrel includes a safety modification, including a rod member positioned within a portion of the bore of the barrel adjacent to the chamber to prevent insertion or loading of a live round. In particular, the rod member includes a first end, a second end, and a central portion defined there between. The first end of the rod member is received through a first aperture defined on a proximal portion of the barrel (adjacent the chamber portion) and passes transversely through the barrel relative to the length of the barrel and is further received through a second aperture opposing the first aperture. When in place, the central portion of the rod member is substantially orthogonal or perpendicular to a longitudinal axis formed along the length of the barrel. The rod member is securely fixed within the barrel by way of welds to the first and second ends at the first and second apertures, thereby making the safety modification permanent.

The modified barrel furthers include a standard blank-firing adapter (BFA) fixedly coupled to the distal or muzzle end of the barrel. The distal end of the barrel is modified to include threading within the bore operable to receive a corresponding threaded connector member of a BFA. Upon coupling of the BFA to the distal end of the barrel, the BFA is securely fixed to the distal end of the barrel by way of welding to prevent removal, thereby providing a permanently coupled BFA.

In another aspect, the invention may include an alternative embodiment of modified barrel having a modified bore for live-round prevention. The modified bore is shaped and/or sized to prevent chambering and further discharge of a live round. In particular, the dimensions of the chamber portion at the proximal end of the modified barrel are insufficient (i.e. too small) to receive a standard live round for a particular firearm, thereby preventing chambering and discharge of a live round. Rather, the chamber portion is shaped and/or sized to receive only blank rounds for use with the particular firearm. Further, the bore of the distal end or muzzle of the barrel is shaped and/or sized to mimic the dimensions of a BFA bore, thereby providing a built-in BFA modification for the barrel.

Each of the embodiments described herein may further include visual indications (e.g. markings) for providing indication that the firearm is a blank-only weapon. In particular, components including the safety modifications described herein, such as the permanently attached BFA and the modified barrel, may include visual markings indicating the blank-firing operability.

The safety components/modifications consistent with the present disclosure are adaptable to most weapon systems, including, but not limited to, handguns, long guns, rifles, shotguns, and carbines. The safety components/modifications of the present invention may be especially suitable for automatic weapons, such as, for example, machine guns, submachine guns, automatic rifles, and assault rifles. The safety components/modifications provide relatively simple and effective means of modifying previously live-fire capable weapons, thereby providing realistic Opposing Forces or Opposition Force (OPFOR) weapons that produce an effective sound signature. The embodiments described herein increase safety, require less inspections and supervisory personnel, and provide realistic training.

Turning to FIG. 1, one embodiment of a firearm 10 to be modified with safety components/modifications consistent with the present disclosure is generally illustrated. FIG. 1 shows an exemplary AK-47 assault rifle 10 having a conventional configuration, i.e., does not include the live-round prevention safety components/modifications of the present disclosure. It should be noted that embodiments of the invention consistent with the present disclosure are suitable for a variety of firearm types, including, but not limited to, handguns, long guns, rifles, shotguns, carbines, machine guns, submachine guns, automatic rifles, and assault rifles. As such, it is understood that the invention is not limited to use with an AK-47 assault rifle, but is merely intended for the purposes of discussion.

The firearm 10 includes a body 12, including a receiver assembly 14, a stock 16, and a barrel 18. As shown, the barrel 18 generally defines the forward portion of the firearm 10 and the stock 16 defines the rearward portion of the firearm 10. The firearm 10 further includes a handle 20, a trigger 22, and trigger guard 24 coupled to the body 12 and receiver assembly 14. The receiver assembly 14 may serve as a support for all major components and may house action components (not shown) of the firearm 10, and, through a series of cam ways, may control operation (e.g., firing) of the firearm 10. The firearm 10 also includes a detachable magazine 26 attached to the receiver assembly 14, wherein the magazine 26 stores and provides ammunition to be discharged by the firearm 10. The barrel 18 may include a grip 28 component as a well as a sight 30 coupled thereto. The firearm 10 may include other features known in the art.

Figure 2:
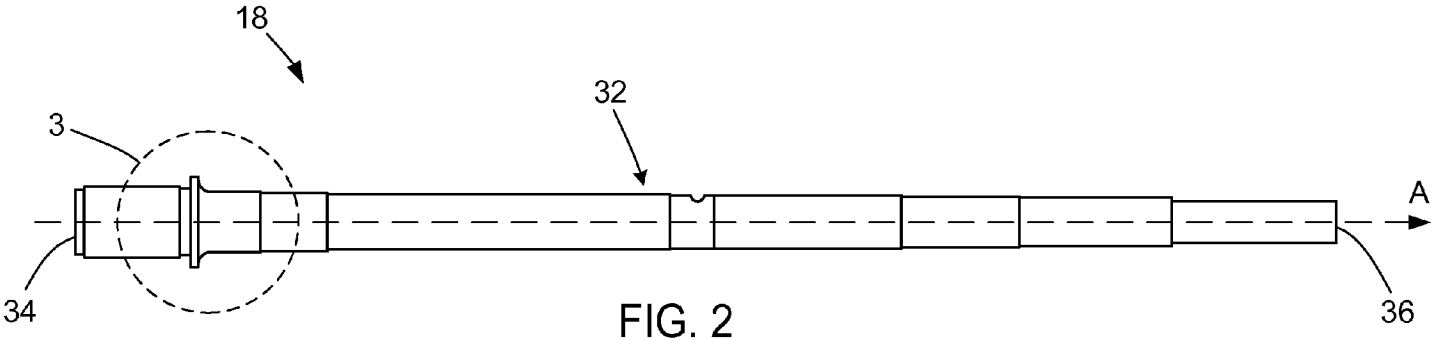
FIG. 2 is a side view of a barrel of the firearm of FIG. 1.

FIG. 2 is a side view of the barrel 18 of the firearm 10 of FIG. 1. For purposes of clarity, the barrel 18 is shown without additional components (e.g., grip 28 and sight 30, rear sight block, etc.). The barrel 18 includes a body portion 32 having a proximal end 34, or chamber end, (adapted to be directly coupled to receiver assembly 14) and distal end 36, or muzzle end. The barrel 18 includes a central bore 44 (shown in FIGS. 4A, 4B, and 5) formed along the entire length of the body 32, from the proximal end 34 to the distal end 36, generally along a longitudinal axis A. As generally understood, the barrel 18, specifically a portion of the bore 44, receives a controlled explosion or rapid expansion of released gases to propel a projectile (e.g., bullet) from the chamber at the proximal end 34 through the bore 44 of the body 32 and out of the muzzle at the distal end 36 at a relatively high velocity (e.g., 120 m/s (390 ft/s) to more than 1,200 m/s (3,900 ft/s)).

Figure 3:
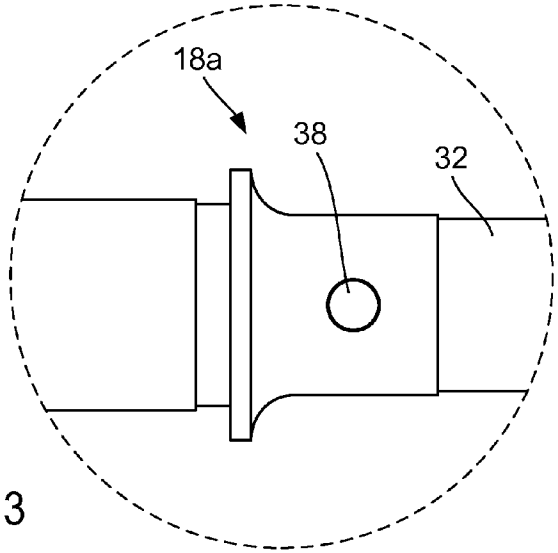
FIG. 3 is an enlarged side view of a proximal portion of a modified barrel for use with a firearm of FIG. 1 including one embodiment of a safety modification consistent with the present disclosure.

FIG. 3 is an enlarged side view adjacent a proximal portion 34 of a modified barrel 18*a* including one embodiment of a safety modification consistent with the present disclosure. As shown, an aperture 38 is formed within a portion of the body 32 of the barrel 18*a*. The aperture 38 is formed within a portion of the body 32 adjacent to the chamber portion (e.g., area of the bore adapted to initially receive ammunition (e.g., cartridge) upon loading of the ammunition into the barrel). The aperture 38 is shaped and/or sized to receive a rod member to be positioned within the chamber portion of the bore. As described in greater detail herein, the rod member is adapted to prevent insertion and/or loading of at least a live round in the firearm.

Figure 4A:
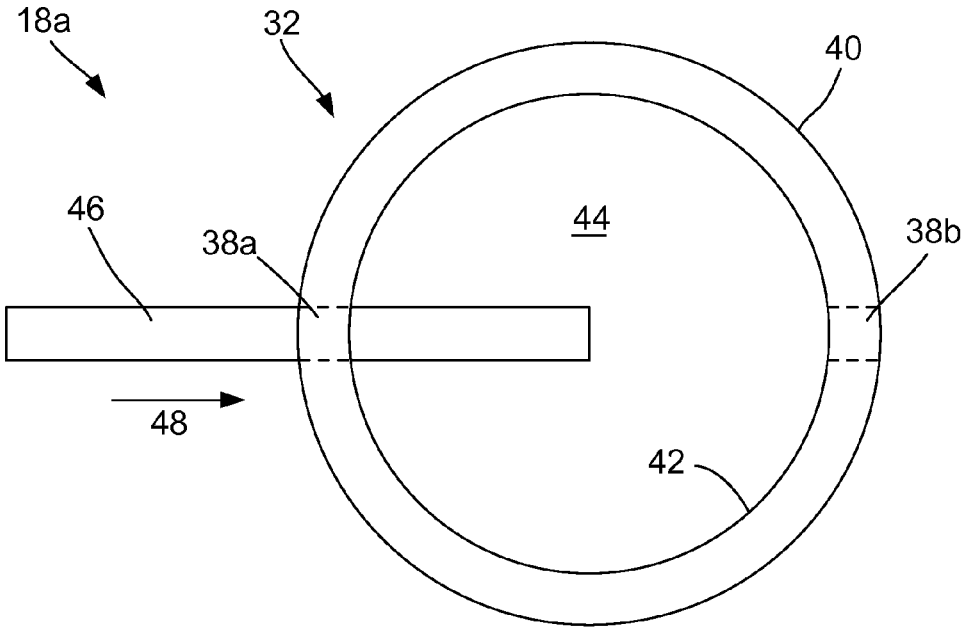
FIGS. 4A and 4B are front (distal or muzzle facing) views of the modified barrel of FIG. 3 illustrating a safety modification including a rod positioned within the barrel and preventing live-round chambering.
Figure 4B:
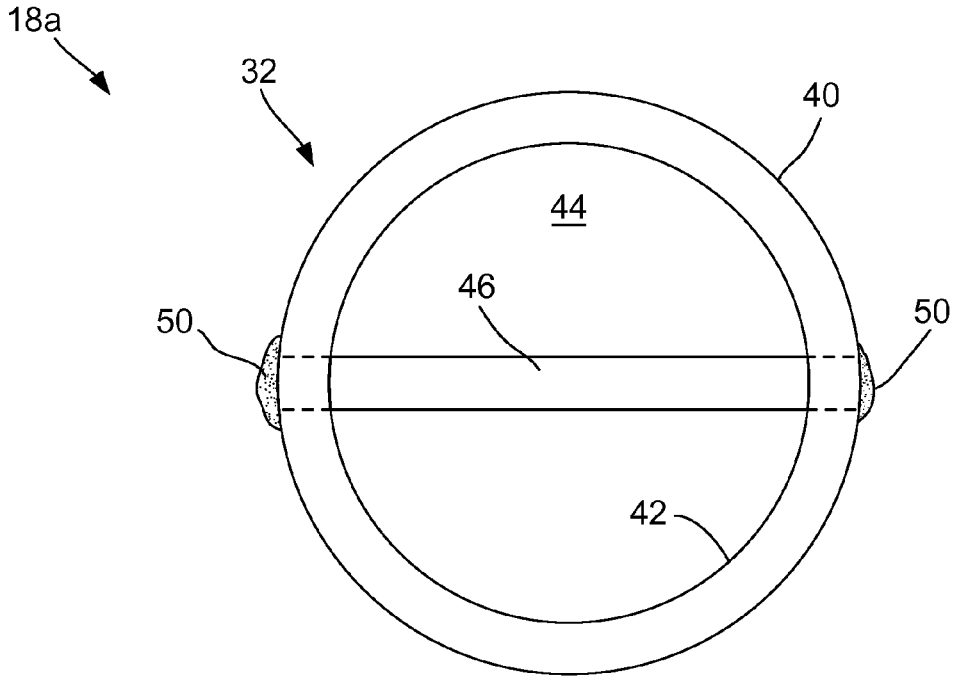

FIGS. 4A and 4B are front (distal or muzzle facing) views of the modified barrel 18*a* of FIG. 3 illustrating the safety modification for preventing chambering of a live round. As shown, the body 32 of the barrel 18*a* is generally tubular in shape and includes an outer surface 40 and an inner surface 42, wherein the bore 44 is formed within. The rod member 46 generally includes a first end and a second opposing end with a body portion formed there between. As shown, first and second apertures 38*a*, 38*b* are formed within the body 32 of the barrel 18*a*, wherein the apertures 38*a*, 38*b* generally oppose one another on either side of the barrel 18*a*. Each aperture 38*a*, 38*b* extends from the outer surface 40 to the inner surface 42 of the body 32.

Referring to FIG. 4A, the first end of the rod member 46 is inserted and passes transversely through the first aperture 38*a*, as indicated by arrow 48, and continues until the first end is further received within the second aperture 38*b* (shown in FIG. 4B), such that the rod member 46 is supported by the first and second apertures 38*a*, 38*b*. When fully inserted within the bore 44, the rod member 46 is positioned transversely within the bore 44 relative to the length of the barrel 18*a*. More specifically, the central portion of the rod member 46 is substantially orthogonal or perpendicular to the longitudinal axis A formed along the length of the barrel 18*a*. The rod member 46 is securely fixed within the bore 44 by way of welds 50 to the first and second ends at the first and second apertures 38*a*, 38*b*. It should be noted that the rod member 46 may be securely fixed within the bore 44 by other known means (e.g., adhesive, fasteners, such as screws, bolts, etc.).

Figure 5:
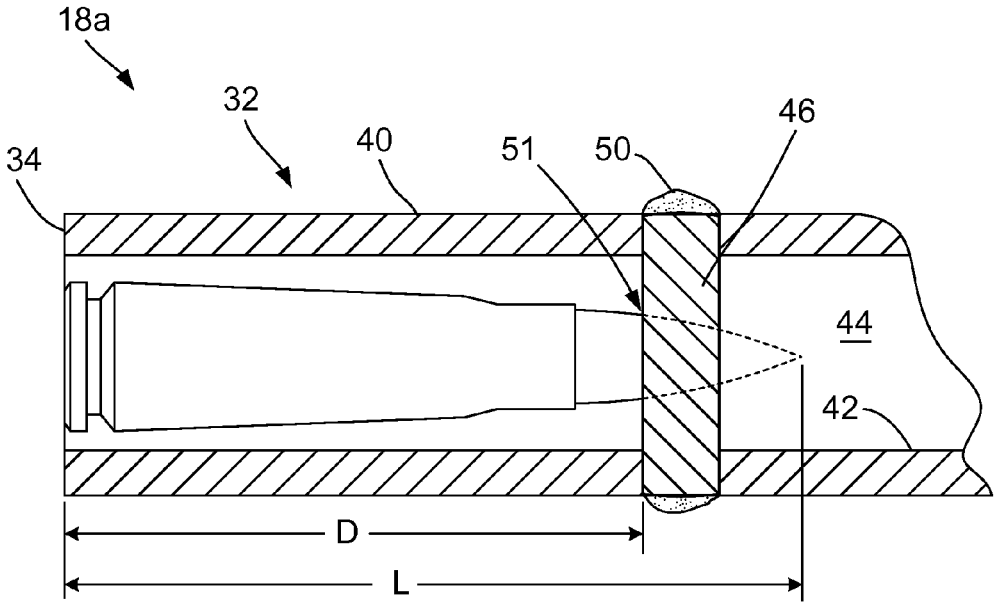
FIG. 5 is a top sectional view of the modified barrel of FIG. 4B illustrating positioning of the rod within the barrel and preventing live-round chambering.

Upon being positioned within the bore 44 adjacent to the chamber portion, the rod member 46 is adapted to prevent loading of a live round into the barrel 18*a*. As shown in FIG. 5, inclusion of the rod member 46 within a particular portion of the bore 44 (e.g., within chamber portion) prevents (i.e., blocks) a standard live round of ammunition from being chambered into the barrel 18*a*. In particular, the rod member 46 is positioned within the bore 44 at a distance D from the proximal end 34 that is less than a length L of a live round of ammunition for use with the firearm.

As generally understood, a round, or cartridge, of ammunition, may come in different lengths, shapes, and diameters depending on the type of firearm, and may further be dictated based on the specific type of bullet and/or case to be used. For example, the standard live round of ammunition for an AK-47 rifle is a 7.62×39 mm cartridge, which generally has an overall length of 56.00 mm (from rim portion to tip of bullet). In this example, the rod member 46 is positioned within the bore 44 at a distance D from the proximal end 34 that is less than 56 mm, the length L of the standard live-fire 7.62×39 mm cartridge, thereby preventing loading of the 7.62×39 mm cartridge into the modified barrel 18*a* (bullet portion of cartridge would be blocked by rod member 46 during loading attempt, as indicated by arrow 51). It should be noted that the rod member 46 may be positioned within the bore 44 at any distance D from the proximal end 34 so as to prevent loading of any particular live round of ammunition. Accordingly, the permanently installed rod member 46 renders the firearm inoperable with live round ammunition, as the rod member 46 prevents chambering of a live round and further prevents conversion of the firearm, at least the barrel 18*a*, to live-fire capabilities.

It should be noted, however, that the distance D between the proximal end 34 of the barrel 18*a* and the rod member 46 positioned within the bore 44 is generally sufficient (e.g. large enough) to allow loading of blank rounds of ammunition into the barrel 18*a*. For example, a blank round 70 (shown in FIG. 10) compatible with the firearm to which the barrel 18*a* is to be coupled may have a length $L_2$ that is less than the distance D between the proximal end 34 of the barrel 18*a* and the rode member 46. Accordingly, while preventing chambering of a live round, the rod member 46 is positioned within the bore 44 at a distance D from the proximal end 34 sufficient to allow the receipt of a blank round, thereby only allowing the chambering and subsequent discharging of the blank round from a firearm to which the barrel 18*a* is coupled. Accordingly, the modified barrel 18*a* is adapted to prevent loading of live rounds of ammunition while allowing only loading of blank rounds of ammunition.

The rod member 46 may include a material of sufficient strength and durability to withstand continual attempts of loading live round ammunition. Furthermore, the rod member 46 may include material having sufficient properties to withstand relatively high thermal conditions as well as exposure to gases, particularly during discharge of ammunition. In some embodiments, the rod member 46 may be composed of the same, or substantially similar, material as other components of the firearm, including the barrel 18*a*, for example. In one embodiment, the rod member 46 is composed of steel.

Figure 6:
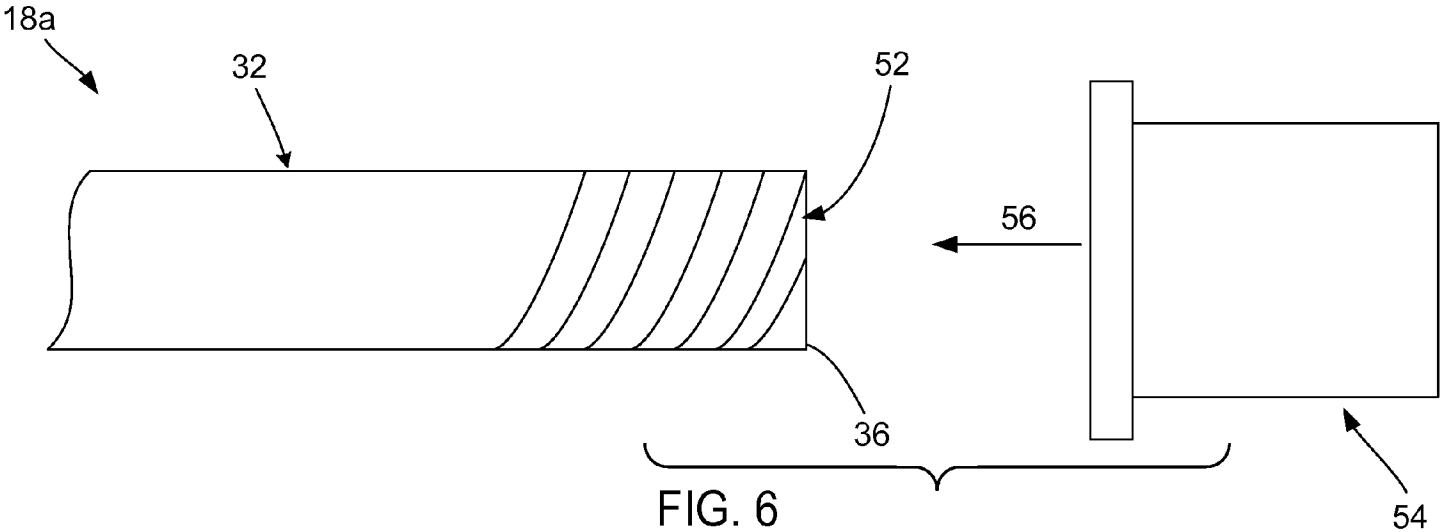
FIGS. 6 and 7 are enlarged side views of a distal portion of the modified barrel of FIG. 3 illustrating a blank-firing adapter in disassembled and fully assembled states.
Figure 7:
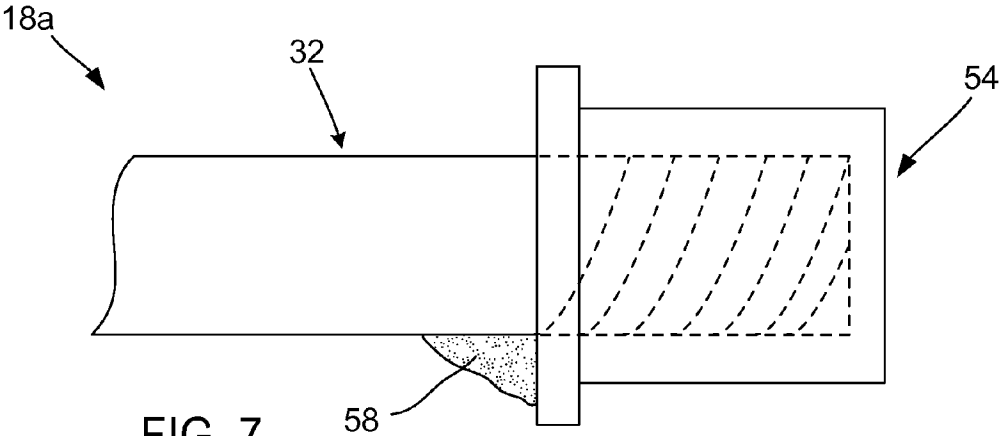

FIGS. 6 and 7 are enlarged side views of the distal portion 36 of the modified barrel 18*a* of FIG. 3 illustrating a blank-firing adapter (BFA) in disassembled and fully assembled states, respectively. As shown, the distal end 36 (also referred to herein as "muzzle") of the barrel 18*a* may be modified so as to receive and be coupled to a BFA 54. In particular, the muzzle 36 may include internal threading 52 defined along the inner surface 42 of the body 32 of the barrel 18*a*. The internal threading 52 may be shaped and/or sized for receiving at least a portion of the BFA 54, as indicated by arrow 56. More specifically, the BFA 54 may include a connector portion defining a threaded surface adapted to engage the corresponding internal threading 52 of the muzzle 36 of the barrel 18*a* and secure the BFA 54 to the muzzle 46.

Referring to FIG. 7, once coupled to the muzzle 36, the BFA 54 may be securely fixed to the muzzle 36 by way of welding 58, for example, so as to prevent removal of the BFA 54, thereby providing a permanently coupled BFA 54. The BFA 54 generally ensures proper operation of the firearm when using blank rounds and can further act as an additional safety measure (e.g., blocks debris during discharge).

The modified barrel 18*a* (including the rod member 46 and permanent BFA 54) may further include visual indications (e.g. markings) for providing indication that the firearm 10 is a blank-only weapon. In particular, the BFA 54 may include a visual marking, such as a specific color (e.g., blue), indicating the blank-firing operability. Use of visual indications will provide users with a quick method of visually inspecting weapons in training.

Figure 8:
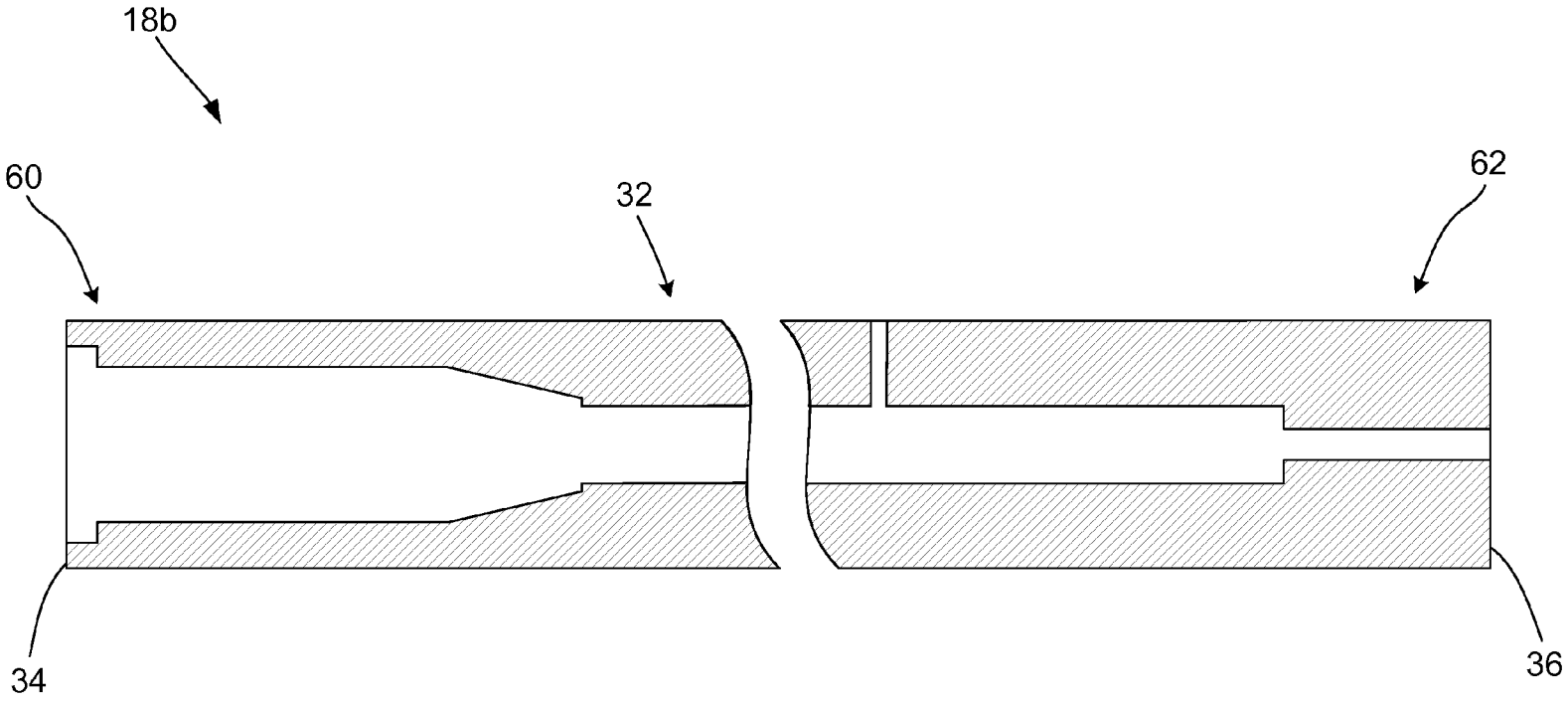
FIG. 8 is a cross-sectional view of another embodiment of a modified barrel compatible with the firearm of FIG. 1 consistent with the present disclosure.

FIG. 8 is a cross-sectional view of another embodiment of a modified barrel 18*b* compatible with the firearm 10 of FIG. 1 consistent with the present disclosure. Similar to the barrel 18 of FIG. 2, the modified barrel 18*b* generally includes a body 32 having a proximal end 34 and an opposing distal end 36. The body 32 generally includes a modified bore extending along the length of the barrel 18*b* from the proximal end 34 to the distal end 36. A chamber portion 60 of the barrel 18*b* is defined adjacent to the proximal end 34, generally adapted to receive (e.g. chamber) a loaded round of ammunition and a muzzle 62 portion of the bore is defined adjacent to the distal end 36. As described in greater detail herein, the modified bore is adapted to prevent the loading of live rounds of ammunition, thereby preventing subsequent discharge of such live ammunition. The modified bore is further adapted to allow only the chambering, loading, and discharge of blank rounds of ammunition.

Figure 9:
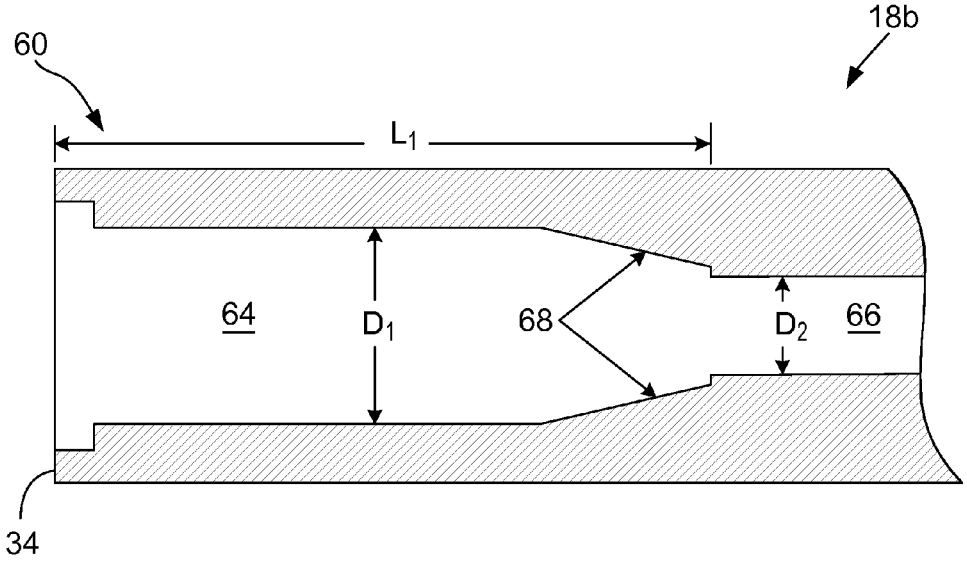
FIG. 9 is an enlarged cross-sectional view of the proximal portion of the modified barrel of FIG. 8.

FIG. 9 is an enlarged cross-sectional view of the proximal portion 34 of the barrel 18*b* of FIG. 8. As shown, a first portion 64 of the bore is formed in the chamber portion 60 of the barrel 18*b*. The first portion 64 generally extends from the proximal end 34 towards the distal end 36 of barrel 18*b*, having a length $L_1$. The first portion 64 further includes a tapered portion 68, tapering from a diameter $D_1$ of the first portion 64 to a diameter $D_2$ of a central portion 66 of the bore. The dimensions of the first portion 64 correspond to the dimensions and specifications of a blank round of ammunition for use with the particular firearm.

Figure 10:
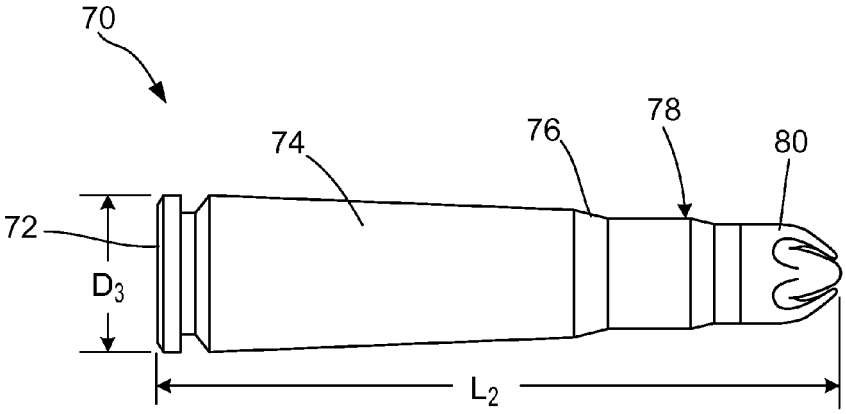
FIG. 10 is a side view of a blank round compatible with the modified barrel of FIG. 8.

As generally understood, ammunition comes in different lengths, shapes, and diameters depending on the type of bullet or case used. For example, a blank round 70 compatible with the modified bore of the barrel 18*b* is shown in FIG. 10. The blank round 70 includes a base 72 (including rim portion), a body 74, a shoulder 76, a neck area 78 and the crimped portion 80. The blank round 70 has a length $L_2$ and diameter $D_3$. The length $L_1$ and diameter $D_1$ of the first portion 64 of the bore are approximately equal to the length $L_2$ and diameter $D_3$ of the blank round. Additionally, the tapered portion 68 of the first portion 64 of the bore corresponds to the shoulder 76 and/or neck area 78 of the blank round 70. Accordingly, the first portion 64 is shaped and/or sized to receive the blank round 70, thereby allowing chambering and subsequent discharge of the blank round 70.

The first portion 64 of the bore is shaped and/or sized to prevent chambering and further discharge of a live round. In particular, the dimensions (length $L_1$, diameter $D_1$ and tapered portion 68) of the first portion 64 of the bore are insufficient (i.e. too small) to receive a live round of ammunition (e.g., length, diameter and shape of live round are greater than $L_1$, $D_1$ and tapered portion 68). Furthermore, even in the event that a live fire round is chambered, the diameter $D_2$ of the central portion 66 of the bore is much smaller than a standard diameter of a live round (smaller than $D_1$), thereby preventing a discharged live round from traveling through the barrel 18*b*.

Figure 11:
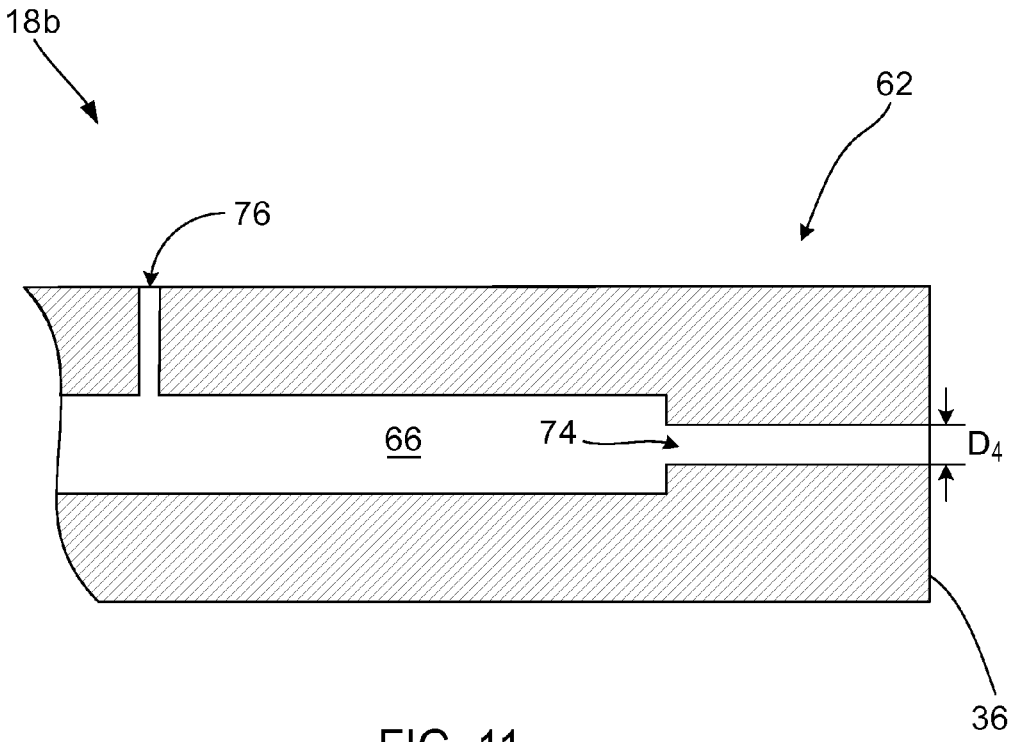
FIG. 11 is an enlarged cross-sectional view of the distal portion of the modified barrel of FIG. 8.

FIG. 11 is an enlarged cross-sectional view of the distal portion 36 of the barrel 18*b* of FIG. 8. As shown, the central portion 66 of the bore extends along the length of the barrel 18*b* from the first portion 64 of the bore to a second portion 74 of the bore formed at the distal end 36 and forming the muzzle 62. The second portion 74 has a diameter $D_4$ less than diameter $D_1$ of the first portion 64 and diameter $D_2$ of the central portion 66. The second portion 74 may generally be shaped and/or sized to mimic or replicate the dimensions of a BFA bore. Accordingly, the second portion 74 generally provides a built-in BFA modification for the barrel 18*b*. The central portion 66 of the bore includes a gas port 76 extending therefrom and passing through a portion of the body 32 of the barrel 18*b*. As generally understood, the gas portion is adapted to allow release and/or dissipation of excess gas released as a result of discharge of a blank round of ammunition.

According to one embodiment of the present disclosure, there is provided a modified barrel for preventing discharge of live ammunition from a firearm. The modified barrel includes a body having a proximal end and an opposing distal end and a bore defined along the length of the body from the proximal end to the distal end. The modified barrel further includes a rod member transversely positioned within a portion of the bore adjacent to the proximal end of the body. The rod member prevents receipt of a live round into at least the proximal end of the body while permitting receipt of a blank or non-lethal round into at least the proximal end.

According to another embodiment of the present disclosure, there is provided a modified barrel for preventing discharge of live ammunition from a firearm. The modified barrel includes a body having a proximal end and an opposing distal end and a bore defined along the length of the body from the proximal end to the distal end. The bore includes a first portion formed adjacent to the proximal end of the body of the barrel. The first portion is shaped and/or size to prevent receipt of a live round into a portion thereof while permitting receipt of a blank or non-lethal round into a portion thereof. The bore further includes a central portion formed adjacent to and in fluid communication with the first portion and a second portion formed adjacent to the distal end of the body and in fluid communication with the first and central portions.

According to yet another embodiment of the present disclosure, there is provided a safety assembly for preventing discharge of live ammunition from a firearm. The safety assembly includes a firearm and a modified barrel coupled to the firearm and adapted to prevent discharge of live ammunition from the firearm. The barrel includes a body having a proximal end and an opposing distal end and a bore defined along the length of the body from the proximal end to the distal end. The barrel further includes a rod member transversely positioned within a portion of the bore adjacent to the proximal end of the body. The rod member is adapted to prevent receipt of a live round of ammunition into at least the proximal end of the body while permitting receipt of a blank or non-lethal round of ammunition into at least the proximal end.

While several embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present disclosure is/are used.

Those skilled in the art will recognize, or be able to ascertain using no more than routine experimentation, many equivalents to the specific embodiments of the disclosure described herein. It is, therefore, to be understood that the foregoing embodiments are presented by way of example only and that, within the scope of the appended claims and equivalents thereto, the disclosure may be practiced otherwise than as specifically described and claimed. The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A barrel for preventing discharge of live ammunition from a firearm, the barrel comprising:

a body having a proximal end, an opposing distal end, and a bore extending from the proximal end to the distal end, the bore comprising:

a first portion adjacent to the proximal end of the body of the barrel, the first portion is shaped and/or sized to prevent receipt of a live round of ammunition into a portion thereof, while permitting receipt of a blank round of ammunition into a portion thereof, wherein the first portion of the bore has a length and a diameter less than a length and diameter of the live round of ammunition for a firearm to which the barrel is coupleable to;

a central portion adjacent to and in fluid communication with the first portion, wherein the central portion of the bore has a diameter less than the diameter of the first portion and less than the diameter of the live round of ammunition; and a second portion adjacent to the distal end of the body and in fluid communication with the first and central portions, wherein the second portion of the bore has a diameter less than the diameter of the central portion.

2. The barrel of claim 1, wherein the length and diameter of the first portion is greater than or equal to a length and diameter of the blank round of ammunition for a firearm to which the barrel is coupleable to.

3. The barrel of claim 1, wherein the first portion has a shape and/or contour corresponding to a shape and/or contour of the blank round of ammunition for a firearm to which the barrel is coupleable to.

4. The barrel of claim 1, further comprising a gas port extending from an exterior surface of the body of the barrel into the central portion of the bore and adapted to allow release and/or dissipation of excess gas released as a result of discharge of the blank round of ammunition.

5. A safety assembly for preventing discharge of live ammunition from a firearm, the assembly comprising:

a firearm; and a barrel coupled to the firearm and adapted to prevent discharge of a live round of ammunition from the firearm, the barrel comprising:

a body having a proximal end, an opposing distal end, and a bore extending from the proximal end to the distal end, the bore comprising:

a first portion adjacent to the proximal end of the body of the barrel, the first portion is shaped and/or sized to prevent receipt of a live round of ammunition into a portion thereof, while permitting receipt of a blank round of ammunition into a portion thereof, wherein the first portion of the bore has a length and a diameter less than a length and diameter of the live round of ammunition for a firearm to which the barrel is coupleable to;

a central portion adjacent to and in fluid communication with the first portion, wherein the central portion of the bore has a diameter less than the diameter of the first portion and less than the diameter of the live round of ammunition; and a second portion adjacent to the distal end of the body and in fluid communication with the first and central portions, wherein the second portion of the bore has a diameter less than the diameter of the central portion.

6. The safety assembly of claim 5, wherein the length and diameter of the first portion is greater than or equal to a length and diameter of the blank round of ammunition for a firearm to which the barrel is coupleable to.

7. The safety assembly of claim 5, wherein the first portion has a shape and/or contour corresponding to a shape and/or contour of the blank round of ammunition for a firearm to which the barrel is coupleable to.

8. The safety assembly of claim 5, further comprising a gas port extending from an exterior surface of the body of the barrel into the central portion of the bore and adapted to allow release and/or dissipation of excess gas released as a result of discharge of the blank round of ammunition.

9. The safety assembly of claim 5, wherein the firearm is selected from the group consisting of a handgun, long gun, rifle, shotgun, carbine, machine gun, submachine gun, automatic rifle, and assault rifle.

* * * * *